United States Patent [19]

Hirsch et al.

[11] Patent Number: 4,968,098

[45] Date of Patent: Nov. 6, 1990

[54] COAL SEAM DISCONTINUITY SENSOR AND METHOD FOR COAL MINING APPARATUS

[75] Inventors: Robert L. Hirsch; Fred W. Ng; Amjad A. Bseisu, all of Dallas, Tex.

[73] Assignee: Atlantic Richfield Company, Los Angeles, Calif.

[21] Appl. No.: 405,365

[22] Filed: Sep. 11, 1989

[51] Int. Cl.[5] ..... E21C 35/24

[52] U.S. Cl. ..... 299/1; 73/579

[58] Field of Search ..... 299/1, 79, 91; 73/579, 73/594

[56] References Cited

U.S. PATENT DOCUMENTS 4,143,552 3/1979 Godfrey ..... 299/1 X
4,181,360 1/1980 Wilson ..... 299/1

FOREIGN PATENT DOCUMENTS 253712 1/1970 U.S.S.R. ..... 299/1
976074 11/1982 U.S.S.R. ..... 299/1
1002571 3/1983 U.S.S.R. ..... 299/1
1145130 3/1985 U.S.S.R. ..... 299/1

*Primary Examiner*—Stephen J. Novosad
*Assistant Examiner*—David J. Bagnell
*Attorney, Agent, or Firm*—Michael E. Martin

[57] ABSTRACT

A continuous mining apparatus such as a coal milling or shearing machine includes sensors mounted on the machine frame or on the cutter bits, including an accelerometer and one or more strain gauges, for sensing vibrations and stresses exerted on the cutter bits during operation of the machine. A signal conditioning and amplification circuit provides an audio and/or visual display indicating when the cutter is moving outside of the coal seam and/or is cutting along a cleat or other joint to improve excavation rates while maintaining or lowering stress levels on the cutter bits. The display enables the machine operator to keep from penetrating the roof or floor of the coal seam and to position the cutter to take advantage of natural fracture lines in the seam. The frequency spectrum of the sensor signals is determined to distinguish vibrations caused by bit interaction with the material being cut.

5 Claims, 3 Drawing Sheets

COAL SEAM DISCONTINUITY SENSOR AND METHOD FOR COAL MINING APPARATUS

BACKGROUND OF THE INVENTION

1. Field of the Invention

The present invention pertains to a system and method for sensing the limits of and discontinuities in underground coal seams for optimizing mining of the coal with coal milling machines and the like.

2. Background

In the automated mining of coal using coal milling and shearing machines, the quality of the coal and the rate of excavation can be improved if the limits of the coal seam can be detected and if the coal can be mined along surfaces which exhibit minimum strength such as along cleats, cross-cleats and slips. Conventional practice in coal milling and shearing requires the machine operator to follow strata maps and to visually notice a change in the milling characteristics of the machine to detect penetration of the milling cutters out of the coal seam or to determine discontinuities in the seam. The ability to accurately detect the seam limits and surfaces which present minimum cutting resistance is highly dependent on the experience and alertness of the operator as well as the comparative structural differences between the coal seam and the adjacent formation material.

Accordingly, a system which could automatically detect the movement of the milling cutter out of the coal seam would greatly reduce the amount of foreign material mined with the coal and improve the quality of the coal product. Moreover, the ability to detect the presence of discontinuities or fractures in the coal seam can be used to improve the rate of excavation by adjusting the cutters to mill along the surfaces which define the discontinuity or fracture in the seam. For example, if the presence and direction of cleats or slips in the seam can be detected, the attitude of the milling cutter may be adjusted to take advantage of the discontinuity in the seam provided by these faults to increase the rate of coal production at reduced stress levels on the mining equipment. To this end the present invention has been developed with a view to improving the quality and rate of excavation of coal and similar minerals which are mined by automated or semiautomated machines which effect milling or mechanical cutting of the product.

SUMMARY OF THE INVENTION

The present invention provides a system and method for detecting a change in milling or similar cutting operations for the mining of coal and similar minerals. In accordance with one aspect of the present invention, there is provided a system associated with a coal milling or shearing machine which detects strains and vibrations of the machine cutting elements to provide a signal indicating a change in the cutting forces exerted on the coal seam to minimize the excursion of the cutting machine out of the coal seam. The system of the present invention is also operable to detect the relative resistance to the cutting effort whereby the cutting operation may be conducted along faults or discontinuities in the seam such as are formed by cleats or slips to improve the rate of excavation of the coal and minimize the stresses imposed on the cutting equipment.

In accordance with another aspect of the present invention, a system is provided for a coal mining machine which produces both audible and visual signals indicating the penetration of the machine cutters out of the coal seam or out of a cutting plane which produces the optimal cutting rate of the machine. In accordance with one embodiment of the invention, sensors such as strain gauges and/or accelerometers are mounted on or adjacent to the cutting elements of a coal milling or shearing machine and the output signals from the strain gauges or accelerometers are conditioned and used to furnish an audible signal or a visual display indicating a change in the cutting forces by the machine due to movement of the cutter out of the coal seam or out of an optimal cutting angle or cutting plane. The sensors may be mounted elsewhere on the machine if convenient to do so.

In accordance with yet another aspect of the present invention, there is provided a method for detecting certain vibrations in a coal mining apparatus which are indicative of a change in the cutting characteristics such as might be experienced by moving the cutters out of the coal seam or along or out of a discontinuity in the coal seam. The method of the invention includes providing certain vibration or strain measuring sensors on the apparatus at selected locations and analyzing selected parts of the frequency spectrum of the signals generated by the sensors to determine changes in signal frequency and/or amplitude of signals of a particular frequency which may indicate a change in the material being cut or a change in resistance to cutting of a particular material. The method of the present invention detects certain frequencies of interest while precluding false readings from nonessential signals or "noise".

Advantages of the present invention reside in the ability to mine coal and other minerals with mechanical cutting equipment in an improved manner which reduces the presence of contaminants in the coal, improves the excavation rate, reduces stresses on the cutting machine and thereby provides for faster and more efficient production of quality coal and similar minerals.

Those skilled in the art will further appreciate the above-mentioned advantages and superior features of the present invention together with other aspects thereof upon reading the detailed description which follows in conjunction with the drawing.

BRIEF DESCRIPTION OF THE DRAWING

FIG. 6 is a diagram of a frequency spectrum of the output signal of one of the sensors.

DESCRIPTION OF A PREFERRED EMBODIMENT

Figure 1:
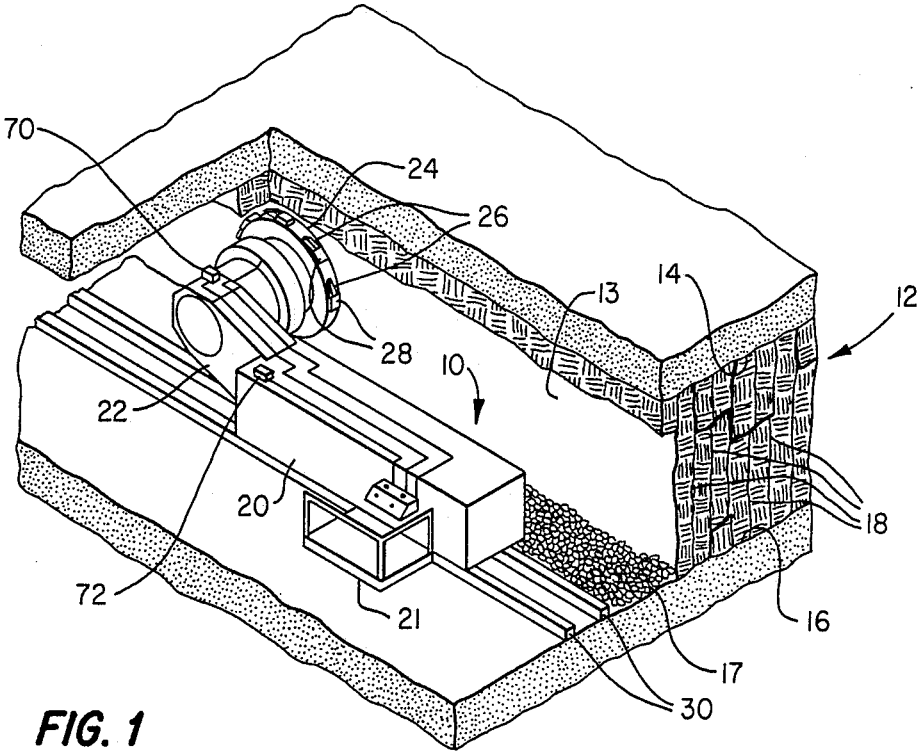
FIG. 1 is a perspective view of a coal shearing machine utilizing the system of the present invention and shown cutting along a face in an underground coal seam.

In the description which follows, like parts are marked throughout the specification and drawing with the same reference numerals, respectively. The drawing figures are not to scale and certain features are shown in schematic form in the interest of clarity and conciseness.

Referring to FIG. 1, there is illustrated a continuous long-wall mining apparatus generally designated by the numeral 10 and sometimes known in the art as a shearer. The shearer 10 is exemplary of so-called continuous miners which mechanically cut or excavate the mineral being mined such as the coal seam 12. The coal seam 12 has upper and lower bedding surfaces 14 and 16 and a plurality of cleats 18 which are generally vertical as illustrated. The direction of the coal seam 12 is for illustrative purposes only as are the specific directions and locations of the cleats 18. Those skilled in the art will appreciate that the bedding planes or surfaces defining the coal seam 12 may extend in different directions as may the cleats 18.

The shearer 10 includes a support frame 20 and a drum support arm 22 which houses suitable drive mechanism for rotating a cutting drum or wheel 24. The cutting drum 24 is fitted with a plurality of cutter elements 26 in the form of bits or picks which are supported in respective socket members 28 about the periphery of the drum 24. The drum 24 may have a spiral configuration on which additional cutters 26, not shown, may be disposed. The drum 24 is supported for rotation on the support arm 22 and is driven by suitable motor means and drive mechanism, also not shown. The shearer 10 is of conventional construction except for the modifications to be described herein and illustrated in the drawing figures. The shearer 10 is provided with a suitable operator control station 21, also of conventional configuration. The shearer 10 is also supported on elongated haulage support rails 30 for traversal along the coal seam 12 to cut coal from the face 13 in a conventional manner through rotation of the drum 24 and haulage of the machine along the supports by conventional mechanism, also not shown. Although the system of the present invention is shown associated with the shearer 10, those skilled in the art will recognize that the advantages and superior features of the present invention may also be implemented on other types of coal cutting machines such as universal type cutting machines, ripping type continuous miners, boring type continuous miners and milling type continuous miners. Moreover, it is contemplated that the present invention may also be utilized on long-wall plow type miners.

In the illustration of FIG. 1, conventional coal conveying equipment for removing coal from the floor 17 adjacent the face 13 has been omitted in the interest of clarity and since such apparatus forms no part of the present invention. The shearer 10 is of the type which may be adjusted vertically to cut the face 13 which has a height greater than the sweep of the cutter drum 24 by making multiple passes of the drum across the face.

Figure 2:
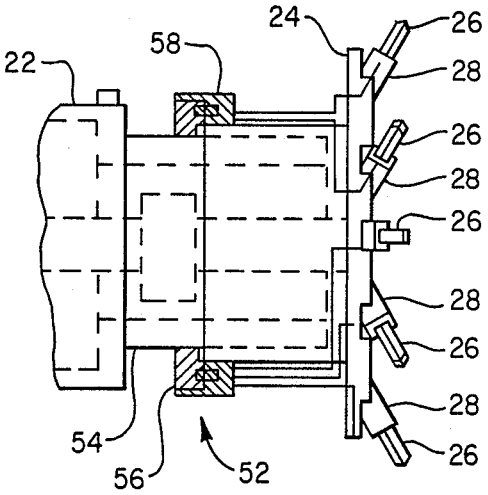
FIG. 2 is a detail view showing one arrangement for transmitting signals from sensors on the coal cutting elements to a signal conditioning and display circuit mounted coal cutting machine.
Figure 3:
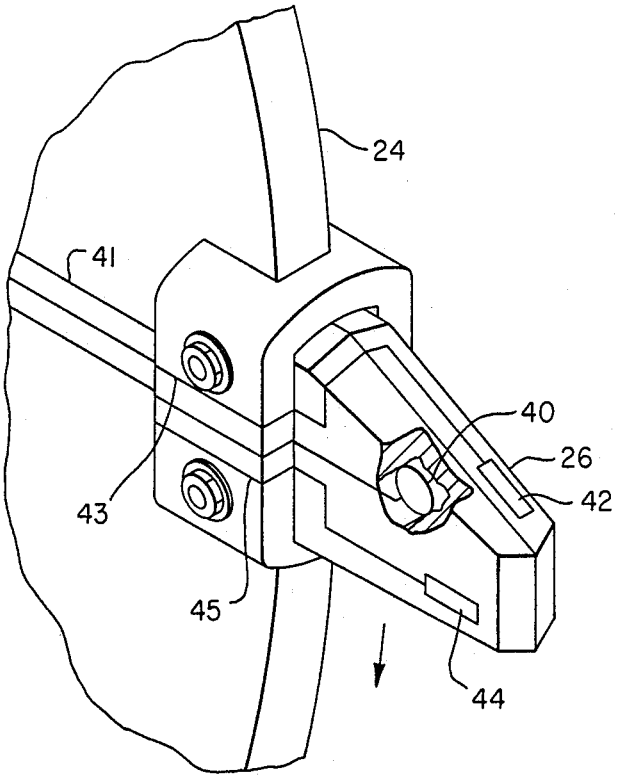
FIG. 3 is a detail view of a coal shearing cutter showing the 1, cation of strain gauge and accelerometer type sensors on a cutting member.

Referring now to FIGS. 2 and 3, and as shown in FIG. 3 by way of example, the drum 24 is fitted with a plurality of circumferentially spaced support sockets 28, one shown, for supporting the cutters 26. The cutter 26 may be one of several types used in conjunction with continuous mining machines of the type described above. In accordance with the present invention, one or more of the cutters 26 is fitted with a vibration sensor in the form a piezoelectric accelerometer 40. In FIG. 3 the accelerometer 40 is illustrated disposed within the cutting element 26 to minimize the prospect of damage to the accelerometer. Alternatively, the accelerometer could be mounted on the support socket 28 also in a protected manner. The cutter 26 is also preferably fitted with one or more piezoelectric strain gauges 42 and 44 which may be disposed to measure strains on the cutter in one or more planes for determining the direction of the resultant load on the cutter as it performs its cutting action against the coal face. The strain gauges 42 and 44 may also be imbedded in the body of the cutter 26 to prevent damage thereto during operation. As further illustrated in FIG. 3, each of the sensors comprising the accelerometer 40, and the strain gauges 42 and 44 includes a signal conductor extending therefrom, respectively, and indicated in FIG. 3 by the numerals 41, 43, and 45. These conductors may also be suitably protected from exposure to abrasion and damage during operation of the drum 24. The exemplary arrangement of sensors 40, 42 and 44 for the cutter 26 as shown in FIG. 3 may be repeated for a selected number of cutters 26 on the periphery of the drum 24.

Figure 4:
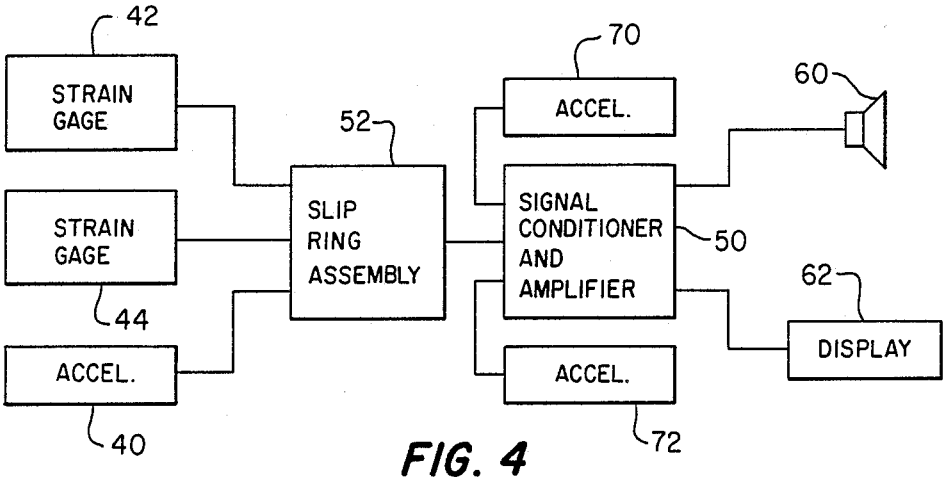
FIG. 4 is a schematic diagram of the signal treating circuit for the system of the present invention.

Signals from each of the sensors 40, 42 and 44 may be transmitted to a suitable signal-receiving, conditioning and amplification circuit as illustrated in FIG. 4 and generally designated by the numeral 50. Signals from the strain gauges 42 and 44 and the accelerometer 40 are transmitted by way of their respective conductors through a conventional multiconductor slipring assembly 52 to the circuit 50. FIG. 2 illustrates the arrangement of the cutter drum 24 which is supported for rotation with respect to a stationary hub 54 disposed on the support arm 22. The slipring assembly 52 includes a conventional stator member 56 supported by the hub 54 and a rotor member 58 supported on the drum 24.

Referring again to FIG. 4, the circuit 50 is adapted to provide a signal to an audio signal generator or speaker 60 which is suitably disposed in proximity to the operator control station 21 so that an operator controlling the mining machine 10 may detect a change in an audible signal which is correlated with a change in the stresses or vibrations imposed on the cutters 26 due to cutting action such as would occur if the cutters were moving away from the seam 12 either above the seam through the bedding surface 14 or below the seam through the bedding surface 16. Since the stresses on the cutters 26 would normally change if the cutters started penetrating different earth material above the surface 14 or below the surface 16 the operator could adjust the position of the arm 22 to bring the cutters 26 back into cutting only the coal material. Moreover, the stresses on the cutters 26 are also related to the cutting effort, which effort is minimized if the cutters are operating parallel to and generally coplanar with a cleat 18 or a similar fracture line in the coal seam 12. Since the stress levels encountered by the cutters 26 are lower if the cutters are operating in a plane which includes the joint or cleat 18, these stress levels would be indicated by readings from the strain gauges 42 and 44. Moreover, the direction of the relative stresses indicated by the strain gauges 42 and 44 may also indicate an optimum angle for the cutting plane of the drum 24 or an optimum cutting angle for the cutters 26, which, in some instances, may be adjustable relative to the plane of rotation of the drum 24. Still further, as previously mentioned, the amplitude as well as possibly the frequency of vibrations of the cutters 26, for a given operating speed of the drum 24, would vary in accordance with the type of material being penetrated by the cutters and these vibration characteristics can be measured and provided as an output signal to indicate to the operator of the machine 10 when the cutters are penetrating material other than coal. As shown in FIG. 4, a visual display 62 may also be provided for receiving suitable output signals from the circuit 50 to indicate the stress levels encountered by the cutters 26 and the vibrational characteristics sensed by the accelerometer 40.

Figure 5:
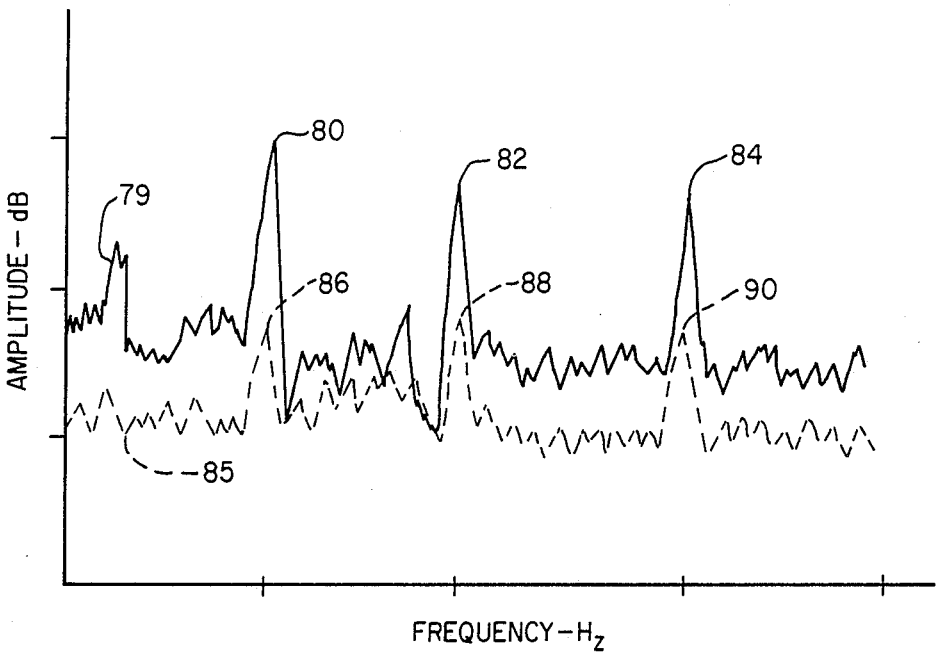

The sensors 40, 42 and 44 may not require to be located on the cutting elements 26 or even on the rotating drum 24. Indeed, it may be preferable to avoid placing the sensors 40, 42 and 44 on the cutting elements 26 to preclude damage to the sensors. Referring to FIG. 1, there is illustrated an alternate arrangement wherein a sensor in the form of an accelerometer 70 is mounted on the support arm 22 and yet a third sensor in the form of an accelerometer 72 is mounted on the machine frame 20. The sensors 70 and 72 are to some extent more likely to sense vibrations other than the vibrations of the cutting elements 26 as the cutting elements encounter the coal seam 12. However, in accordance with a preferred method of analyzing the signals produced by the sensors 40, 42, 44, 70 and 72, the vibrations of the cutting elements and their amplitude and/or frequency may be distinguished from other vibrations of the machine caused by the motor and drive mechanism, for example, and certain machine structure response to such vibrations. For example, referring to FIG. 5, there is illustrated a plot of a selected frequency spectrum of the signals sensed by the accelerometer 40 during operation to cut the coal seam 12. The diagram of FIG. 5 is a plot of a selected range of frequencies on the abscissa versus signal amplitude in decibels on the ordinate. In FIG. 5, the solid line frequency signal characteristic 79 indicates a peak amplitude signal at point 80 with additional peak amplitude signals of somewhat lower intensity at points 82 and 84, which lower peak amplitude signals are multiples of the frequency of the signal 80. The signal 80 is a frequency which is a multiple of the number of cutters times the rotational speed of the drum 24 while the signals 82 and 84 are second and third multiples or harmonics of the frequency of the signal 80.

If the cutters 26 move out of the coal seam 12 into material of greater or lesser hardness, the amplitude of the stresses or vibrations encountered by the cutters 26 may be greater or less, respectively. Accordingly, the dashed line 85 in the diagram of FIG. 5 also shows peak intensity signals at 86, 88 and 90 corresponding to the peak amplitudes at the fundamental frequency as indicated by the point 80 and multiples of that frequency as indicated by the points 82 and 84. Accordingly, by measuring the frequency spectrum of the signals generated by the accelerometer 40 or the strain gauges 42 or 44 or the accelerometers 70 or 72, it is possible to analyze such frequency spectrum to determine a change in certain signals which are related to the cutting effort of the apparatus 10.

The frequency spectrum illustrated in FIG. 5 may be obtained by subjecting a plurality of multiple point consecutive time records of the output signals from the sensors 40, 42, 44, 70 or 72 to fast Fourier transform analysis of the time domain data to produce auto spectra values comprising the magnitude of the Fourier transforms squared or the product of the Fourier transform and its complex conjugate, preferably as running average values, respectively. These values are used to provide the plot of the respective frequency spectrum lines 79 and 85 of FIG. 5. Moreover, by plotting the frequency spectrum of the signals sensed by the sensors 70 and 72, in particular, the amplitude of the signals at the frequency of the number of teeth in the cutting drum 24 times the speed of rotation of the drum, for example, may indicate, for different cutting conditions, a signal amplitude change which may be sensed on a continuous basis and used to adjust the position of the cutter drum relative to the seam 12. These signals may be easily distinguished from random or apparatus structure response vibrations as a result of the spectral analysis. The frequency spectrum of the signals produced by the sensors 40, 42, 44, 70 or 72 may be carried out by a suitable frequency spectrum analyzer included in the signal conditioner and amplification circuit 50.

The operation of the apparatus 10 in conjunction with the circuit illustrated in FIG. 4 is believed to be understandable to those of ordinary skill in the art from the foregoing description. However, briefly, the apparatus 10 is advanced through a coal seam 12 by operating the cutter drum 24 to shear the coal along the face 13 by vertical adjustment of the arm 22 to maintain the cutter in a position which will not cut into the earth material above the surface 14 or below the surface 16. If the depth of cut permits movement of the drum 24 to a position intersecting or aligned with the cleats 18 then, by shearing along the plane of the cleat, the stresses exerted on the apparatus 10 are reduced and the excavation rate for a given power input may be increased. If the seam 12 changes its course, the vibration of the cutters 26, as they penetrate material other than the coal, will change and the accelerometers 40, 70 or 72 will sense such a change to produce a different output signal which may be identified by an audio signal-generating device 60 or visual display 62. Accordingly, the operator may adjust the height of the arm 22 or the advance position of the machine 10 toward the face 13 as required to keep the cutter drum 24 operable to cut only the coal material intended for excavation. In this way greater production of cleaner coal may be obtained than relying solely on visual inspection of the seam during the continuous mining operation.

Although a preferred embodiment of the present invention has been described herein, those skilled in the art will also recognize that various substitutions and modifications may be made to the embodiment described without departing from the scope and spirit of the invention as recited in the appended claims.

What is claimed is:

1. A method for operating a continuous mining apparatus for mining a seam of a mineral value such as coal and the like, said seam having one or more cleats forming a discontinuity in said seam, said apparatus including cutter means supported thereon for cutting said mineral value from said seam, and said apparatus includes sensor means mounted thereon for generating a signal related to at least one of stresses exerted on said cutter means and vibrations of said cutter means, said method including the steps of:

engaging said cutter means with said seam and traversing said cutter means along said seam to cut said mineral value, generating signals related to said at least one of vibrations and stresses on said cutter means while cutting said mineral value, generating a signal related to signals from said sensor means to indicate when said cutter means is cutting along said discontinuity in said seam, and adjusting the position of said cutter means relative to said discontinuity to advance along said discontinuity to maximize the extraction of said mineral value from said seam.

2. The method set forth in claim 1 wherein:

said sensor means comprises accelerometer means mounted on said cutter means and the step of generating said signal comprises generating signals related to vibrations of said cutter means as sensed by said accelerometer means and generating an audible signal corresponding to the signal provided by said accelerometer means and which is indicative of a change in the material being cut by said cutter means.

3. The method set forth in claim 1 wherein:

said sensor means comprise strain gauges mounted on said cutter means for sensing stresses exerted on said cutter means in at least two directions and, adjusting the position of said cutter means relative to said seam to reduce stresses exerted on said cutter means.

4. The method set forth in claim 1 including the step of:

determining a selected frequency spectrum of signals generated by said sensor means and detecting a signal at a frequency which is related to the cutting effort of said cutter means.

5. The method set forth in claim 4 wherein:

the step of determining the frequency spectrum of said signal from said sensor means includes performing Fourier transform analysis on a set of multiple time records of the signals produced by said sensor means; and determining the auto spectra of said transformed time records.

* * * * *